US009909303B2

(12) United States Patent
Ochi

(10) Patent No.: US 9,909,303 B2
(45) Date of Patent: Mar. 6, 2018

(54) BUILDING EXTERIOR INSULATION STRUCTURE

(71) Applicant: Nichiha Corporation, Nagoya-shi, Aichi (JP)

(72) Inventor: Yoshio Ochi, Nagoya (JP)

(73) Assignee: NICHIHA CORPORATION, Nagoya-Shi (JP)

( * ) Notice: Subject to any disclaimer, the term of this patent is extended or adjusted under 35 U.S.C. 154(b) by 0 days.

(21) Appl. No.: 15/455,746

(22) Filed: Mar. 10, 2017

(65) Prior Publication Data

US 2017/0370096 A1 Dec. 28, 2017

(30) Foreign Application Priority Data

Jun. 28, 2016 (JP) ..... 2016-127341

(51) Int. Cl.

| | |
|---|---|
| ***E04B 2/02*** | (2006.01) |
| ***E04B 1/88*** | (2006.01) |
| ***E04B 1/76*** | (2006.01) |
| ***E04F 13/08*** | (2006.01) |
| *E04B 2/56* | (2006.01) |

(52) U.S. Cl.

CPC ..... *E04B 1/762* (2013.01); *E04B 1/7608* (2013.01); *E04B 1/7658* (2013.01); *E04F 13/0803* (2013.01); *E04B 2/02* (2013.01); *E04B 2/562* (2013.01)

(58) Field of Classification Search

CPC ..... E04B 1/7608; E04B 1/7612; E04B 1/762; E04B 1/88; E04B 2/02; E04B 2/28; E04B 2/42; E04B 2/54; E04B 2/562; E04B 2/58; E04B 1/7658; E04F 13/0803

USPC ..... 52/481.1, 483.1, 479, 478

See application file for complete search history.

(56) References Cited

U.S. PATENT DOCUMENTS 2,369,100 A * 2/1945 Young ..... F27D 1/004 110/336
3,305,993 A * 2/1967 Nelsson ..... E04B 2/7457 52/145

(Continued)

FOREIGN PATENT DOCUMENTS

JP 8-218509 A 8/1996
JP 2004-197530 A 7/2004

*Primary Examiner* — Phi A

(74) *Attorney, Agent, or Firm* — Birch, Stewart, Kolasch & Birch, LLP

(57) ABSTRACT

An exterior insulation structure includes a first board member, first supporting members, a first thermal insulator, second supporting members disposed on the exterior side of the first supporting members, a second thermal insulator disposed on the exterior side of the first thermal insulator and between the second supporting members, securing members fixed to the exterior side of the second supporting members, and exterior wall members attached to the securing members. The adjacent exterior wall members are joined together without leaving a gap therebetween. Each securing member is long enough, in the second direction, to be fixable to at least two second supporting members and shorter, in the second direction, than each exterior wall member. A first gap is left between the securing members adjacent in the second direction. At least part of each second supporting member is made of a material having a thermal conductivity lower than that of steel.

11 Claims, 11 Drawing Sheets

(56) References Cited

U.S. PATENT DOCUMENTS

| | | | | | |
|---|---|---|---|---|---|
| 3,324,617 | A * | 6/1967 | Knight | E04F 13/12 | 52/476 |
| 5,907,932 | A * | 6/1999 | LeConte | E04B 2/7411 | 181/210 |
| 6,082,066 | A * | 7/2000 | Mill | E04B 1/0023 | 403/232.1 |
| 8,397,465 | B2 * | 3/2013 | Hansbro | E04B 2/58 | 52/309.14 |
| 2003/0037499 | A1 * | 2/2003 | Coulton | E04B 1/7046 | 52/302.3 |
| 2012/0137610 | A1 * | 6/2012 | Knight | E04B 2/58 | 52/309.1 |
| 2014/0115991 | A1 * | 5/2014 | Sievers | E04B 1/10 | 52/309.4 |
| 2016/0115690 | A1 * | 4/2016 | Jakobsen | E04B 1/18 | 52/404.4 |

* cited by examiner

BUILDING EXTERIOR INSULATION STRUCTURE

CROSS REFERENCES TO RELATED APPLICATIONS

This application is based on Japanese Patent Application No. 2016-127341 filed in the Japanese Patent Office on Jun. 28, 2016, the entire contents of which are hereby incorporated by reference.

BACKGROUND OF THE INVENTION

1. Field of the Invention

The present invention relates to a building exterior insulation structure.

2. Description of the Related Art

Japanese Unexamined Patent Application Publication No. 8-218509 discloses an existing building exterior insulation structure. This exterior insulation structure includes multiple columnar members and first thermal insulators on the exterior side of an interior member. Each first thermal insulator is disposed between a corresponding pair of the columnar members. Second thermal insulators are disposed on the exterior side of the columnar members and the first thermal insulators. Specifically, double layers of thermal insulators are disposed between each pair of columnar members, whereas only the second thermal insulators are disposed on the exterior side of the columnar members, that is, the columnar members are not covered with double layers of thermal insulators. A vertical furring strip is disposed on the exterior side of each second thermal insulator. A siding is disposed on the exterior side of each vertical furring strip. The siding, the vertical furring strip, and the second thermal insulator are collectively fixed to the corresponding columnar member using nails.

Japanese Unexamined Patent Application Publication No. 2004-197530 discloses a different existing building exterior insulation structure. This exterior insulation structure includes multiple frame members, made of metal, and thermal insulators, made of glass wool, on the exterior side of an interior member. Each thermal insulator is disposed between a pair of the frame members. Load-bearing plywood panels are disposed on the exterior side of the frame members and the thermal insulators. Furring strips are disposed on the exterior side of the load-bearing plywood panels. Each furring strip is fixed to a corresponding one of the load-bearing plywood panels using devices such as screws. A siding is hooked on metal fittings to be attached to the exterior side of each furring strip. A board-shaped member made of plastic foam is interposed between each frame member and the corresponding load-bearing plywood panel or between each load-bearing plywood panel and the corresponding furring strip. Each board-shaped member made of plastic foam extends along the frame member or the furring strip.

SUMMARY OF THE INVENTION

In the exterior insulation structure disclosed in Japanese Unexamined Patent Application Publication No. 8-218509, however, the heads of the nails are exposed to the surfaces of the sidings, which impairs the appearance.

In this exterior insulation structure, the nails are used to integrally fix the sidings, the vertical furring strips, and the second thermal insulators to the columnar members. This configuration thus usually requires long nails, which render it difficult to enhance the strength for attaching the sidings.

In the exterior insulation structure disclosed in Japanese Unexamined Patent Application Publication No. 8-218509, the sidings and other members are fixed to the columnar members with nails at positions at which double layers of thermal insulators are not provided. This configuration often allows a heat transfer between the sidings and the columnar members through the nails, the vertical furring strips, and the outer thermal insulators and thus has a low thermal insulation property.

In the exterior insulation structure disclosed in Japanese Unexamined Patent Application Publication No. 2004-197530, additionally disposing a second thermal insulator in a ventilation layer would render it difficult to keep a sufficiently large ventilation layer on the interior side of the sidings. This would conceivably facilitate condensation or other defects on the interior side of the sidings and prevent enhancement in thermal insulation property.

The present invention was made in view of the above-described existing circumstances and aims to provide a building exterior insulation structure having enhanced appearance, enhanced strength for attaching exterior wall members, and enhanced thermal insulation property.

According to a first aspect of the present invention, a building exterior insulation structure includes a first board member disposed on an exterior side of a framework forming a building, the first board member extending in a first direction and a second direction substantially perpendicular to the first direction, a plurality of first supporting members disposed on the exterior side of the first board member, a first thermal insulator disposed on the exterior side of the first board member and between the first supporting members, a plurality of second supporting members disposed on the exterior side of the first supporting members, the second supporting members extending in the first direction and being spaced part from one another in the second direction, and a second thermal insulator disposed on the exterior side of the first thermal insulator and between the second supporting members, a plurality of securing members fixed to the exterior side of the second supporting members and extending in the second direction, and a plurality of exterior wall members attached to the securing members to cover the framework. The exterior wall members adjacent to each other are joined together without leaving a gap therebetween. A length of each securing member in the second direction is determined so as to be long enough to be fixable to at least two of the second supporting members and so as to be shorter than a length of each exterior wall member in the second direction. A first gap is left between each two of the securing members adjacent to each other in the second direction. At least part of each second supporting member is made of a material having a thermal conductivity lower than that of steel.

In the building exterior insulation structure according to the first aspect of the invention, the exterior wall members attached to the securing members and adjacent to one another cover the structure while being joined together without leaving a gap therebetween. Thus, this exterior insulation structure has an enhanced appearance without the heads of the nails being exposed, unlike in an existing structure.

In this exterior insulation structure, each securing member is fixed to the exterior side of at least two second supporting members. Thus, this exterior insulation structure has enhanced strength for attaching the exterior wall members.

In this exterior insulation structure, adjacent exterior wall members are joined together without leaving a gap therebetween. Thus, this exterior insulation structure is capable of preventing rainwater from intruding on the interior side of the exterior wall members. Here, air flows through the first gap left between the securing members adjacent to each other in the second direction. Thus, a sufficiently large ventilation layer is allowed to be left on the interior side of the exterior wall members. In addition, at least part of each second supporting member is made of a material having a thermal conductivity lower than that of steel. This exterior insulation structure is thus capable of effectively preventing a heat transfer through the second supporting members from or to the first supporting members to or from the exterior wall members and the securing member. This exterior insulation structure thus prevents the occurrence of condensation or other defects on the interior side of the exterior wall members and has further enhanced thermal insulation property.

Thus, the building exterior insulation structure according to the first aspect of the invention is capable of enhancing the appearance, the strength for attaching the exterior wall members, and the thermal insulation property.

According to a second aspect of the present invention, preferably, the building exterior insulation structure further includes a second board member disposed on the exterior side of each first supporting member, the second board member extending in the first direction and the second direction in a space between the first thermal insulator and the second thermal insulator. Preferably, the second supporting members are disposed on the exterior side of the first supporting members with the second board member interposed therebetween.

In this configuration, the second board member is capable of separating the first thermal insulator from the second thermal insulator. Thus, this exterior insulation structure is capable of enhancing earthquake resistance and fire resistance and further enhancing the thermal insulation property.

According to a third aspect of the present invention, in the building exterior insulation structure, a second gap is preferably left between each securing member and an exterior surface of the second thermal insulator.

In this configuration, the second gap increases the capacity of the ventilation layer left on the interior side of the exterior wall members and increases the amount of ventilation in the ventilation layer, and is thus capable of effectively removing the humidity on the interior side of the exterior wall members. In addition, this exterior insulation structure further prevents a heat transfer between the securing members and the second thermal insulators since the securing members do not directly come into contact with the second thermal insulators. Thus, this exterior insulation structure is capable of further preventing condensation or other defects from occurring on the interior side of the exterior wall members and has further enhanced thermal insulation property.

According to a fourth aspect of the present invention, preferably, each second supporting member includes a first portion, made of a metal, and a second portion, made of a material containing either a resin material or rock wool or both a resin material and rock wool.

In this configuration, the first portion is capable of enhancing durability against fire. In addition, in this configuration, the second portion is capable of effectively preventing a heat transfer through the second supporting members from or to the first supporting members to or from exterior wall members and the securing members.

According to a fifth aspect of the present invention, preferably, the second portion is located at a portion of each second supporting member closer to a corresponding one of the first supporting members than to a corresponding one of the securing members or closer to the corresponding one of the securing members than to the corresponding one of the first supporting members.

In this configuration, when the second portion is located at a portion of each second supporting member closer to the corresponding first supporting member, the second supporting member and the corresponding securing member can be tightly fixed to each other. If, on the other hand, the second portion is located at a portion of each second supporting member closer to the corresponding securing member, the second supporting member and the first corresponding supporting member can be tightly fixed to each other.

According to a sixth aspect of the present invention, preferably, the second supporting members are made of a material containing either a resin material or rock wool or both a resin material and rock wool.

In this case, the second supporting members are capable of effectively preventing a heat transfer through themselves from or to the first supporting members to or from exterior wall members and the securing members. In addition, the second supporting members themselves have thermal insulation effect. This exterior insulation structure is thus capable of further enhancing the thermal insulation property.

According to a seventh aspect of the present invention, in the building exterior insulation structure, a sealing agent is preferably disposed between each two of the exterior wall members adjacent to each other in the second direction.

In this configuration, the exterior wall members adjacent to each other are joined together by a sealing agent without leaving a gap therebetween. Thus, this exterior insulation structure is capable of effectively preventing rainwater from intruding on the interior side of the exterior wall members and further enhancing the appearance.

According to an eighth aspect of the present invention, preferably, each two of the exterior wall members adjacent to each other in the second direction have a first shiplap portion.

In this configuration, the exterior wall members adjacent to each other are joined together at a first shiplap portion without leaving a gap therebetween. Thus, this exterior insulation structure is capable of effectively preventing rainwater from intruding on the interior side of the exterior wall members and further enhancing the appearance.

According to a ninth aspect of the present invention, each two of the exterior wall members adjacent to each other in the first direction have a second shiplap portion.

In this configuration, the exterior wall members adjacent to each other are joined together at a first shiplap portion and a second shiplap portion by four-side shiplapping without leaving a gap therebetween. Thus, this exterior insulation structure is capable of further effectively preventing rainwater from intruding on the interior side of the exterior wall members and further enhancing the appearance.

According to a tenth aspect of the present invention, the building exterior insulation structure further preferably includes a shift-prevention device including an erect piece disposed between opposing end portions of each two of the exterior wall members adjacent to each other in the second direction.

In this configuration, the erect piece of the shift-prevention device is capable of preventing the exterior wall members from shifting in the second direction.

According to an eleventh aspect of the present invention, the shift-prevention device is preferably attached to each securing member while being superposed on the securing member.

In this configuration, the area of each second supporting member with which the corresponding securing member and the corresponding shift-prevention device come into contact can be reduced compared to the case where the shift-prevention device is fixed to the second supporting member at a portion of the second supporting member different from the portion at which the securing member is fixed to the second supporting member. This exterior insulation structure is thus capable of further enhancing the thermal insulation property.

A building exterior insulation structure according to the invention is capable of enhancing the appearance, the strength for attaching the exterior wall members, and the thermal insulation property.

DESCRIPTION OF THE PREFERRED EMBODIMENTS

Figure 1:
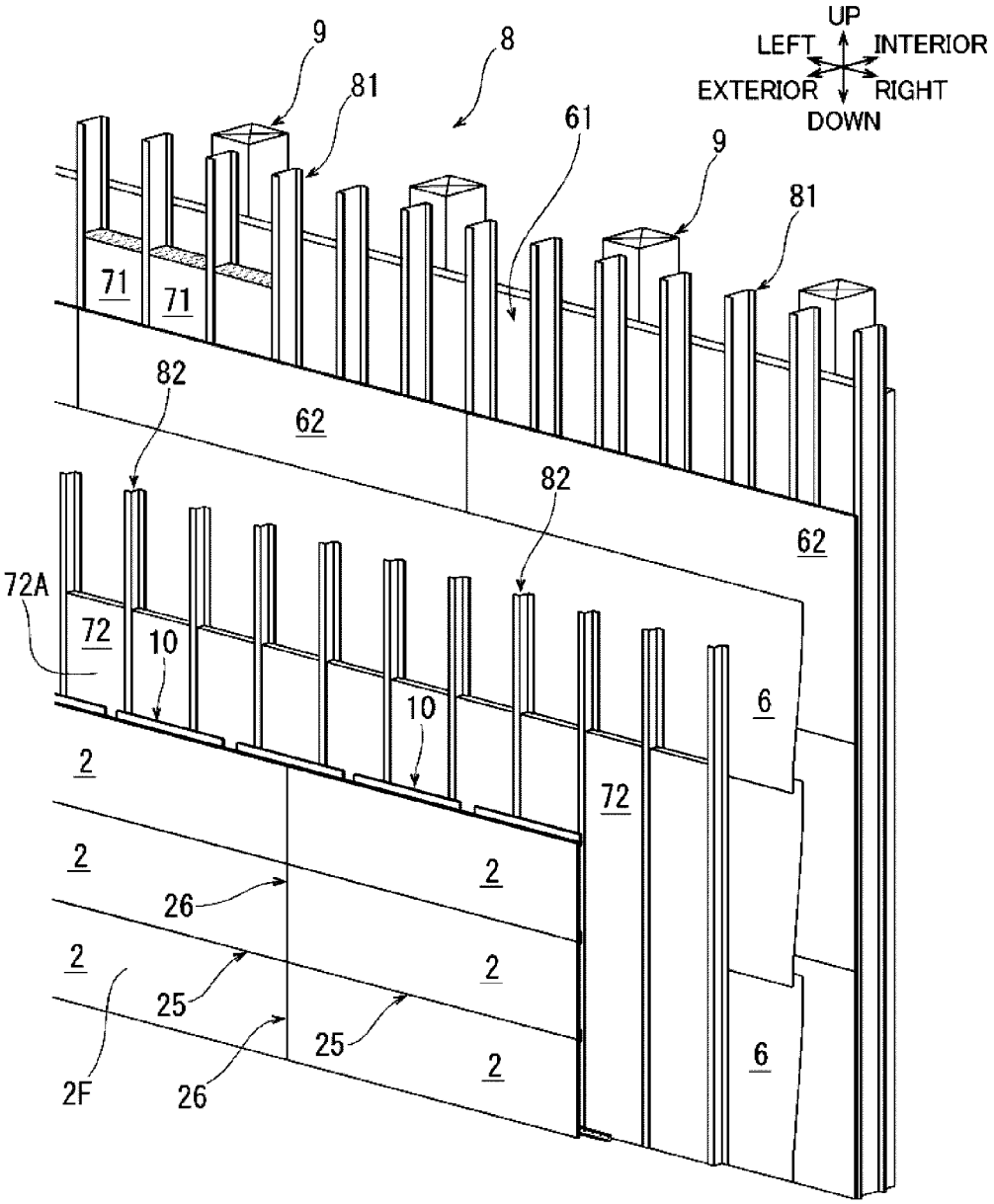
FIG. 1 is a perspective view of an exterior insulation structure according to a first embodiment.
Figure 2:
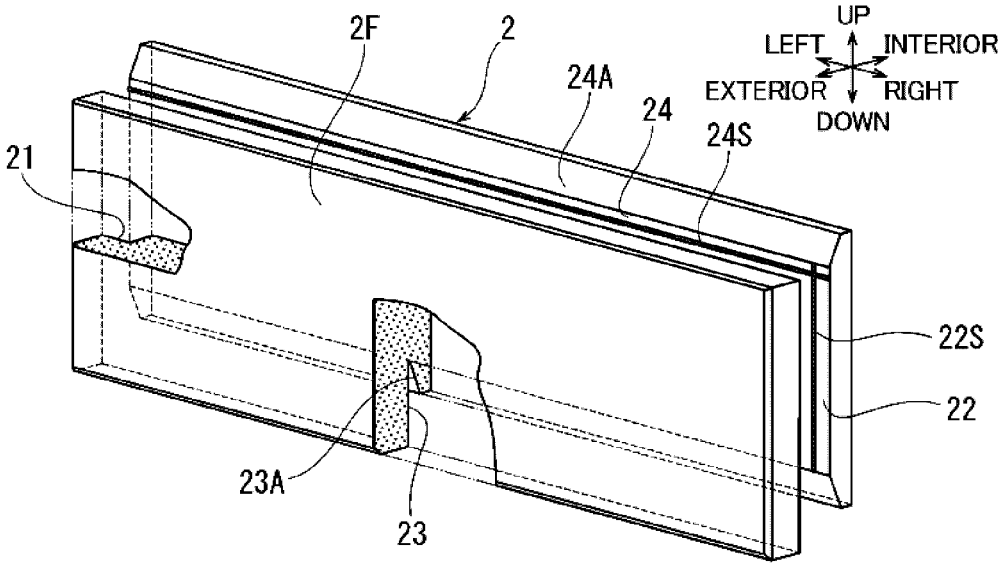
FIG. 2 is a perspective view of an exterior wall member according to the first embodiment.

Hereinbelow, first and second embodiments into which the present invention is embodied are described with reference to the drawings. In FIG. 1, the vertically upward direction is expressed as up and the vertically downward direction is expressed as down. When viewed in the direction from the exterior to the interior in FIG. 1, the horizontally leftward direction is expressed as left and the horizontally rightward direction is expressed as right. The directions throughout the drawings from FIG. 2 are expressed so as to correspond to those in FIG. 1.

First Embodiment

Figure 3:
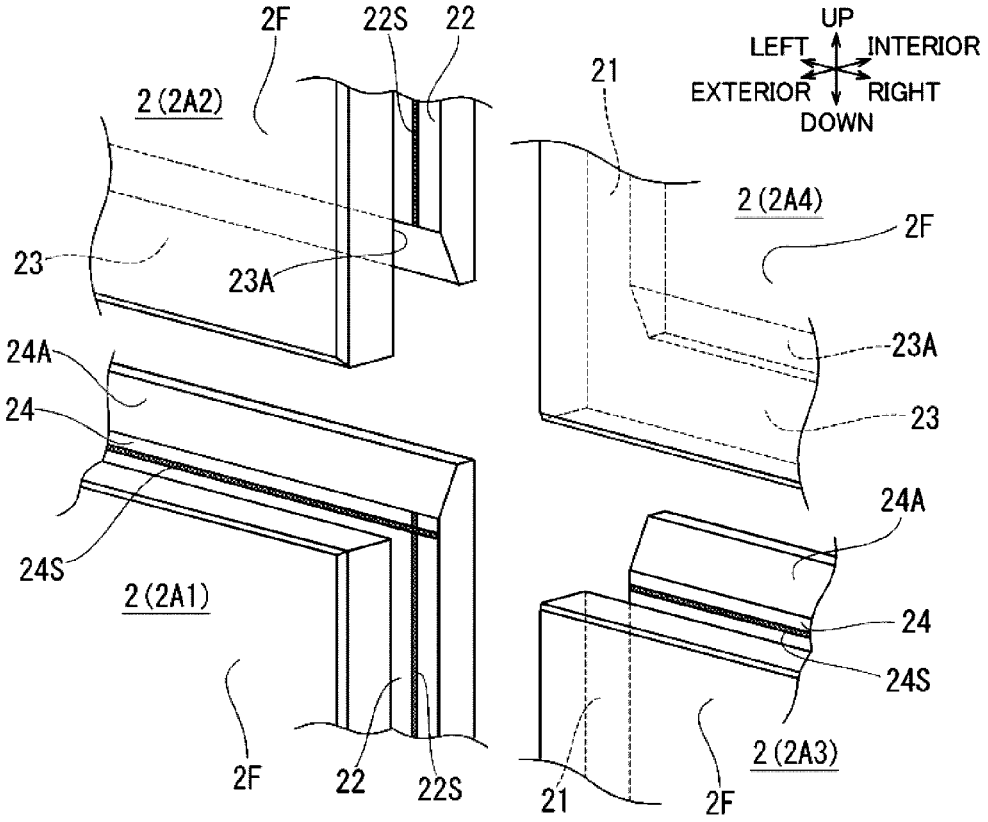
FIG. 3 is a partial perspective view of a configuration in which adjacent exterior wall members according to the first embodiment are assembled together.
Figure 4:
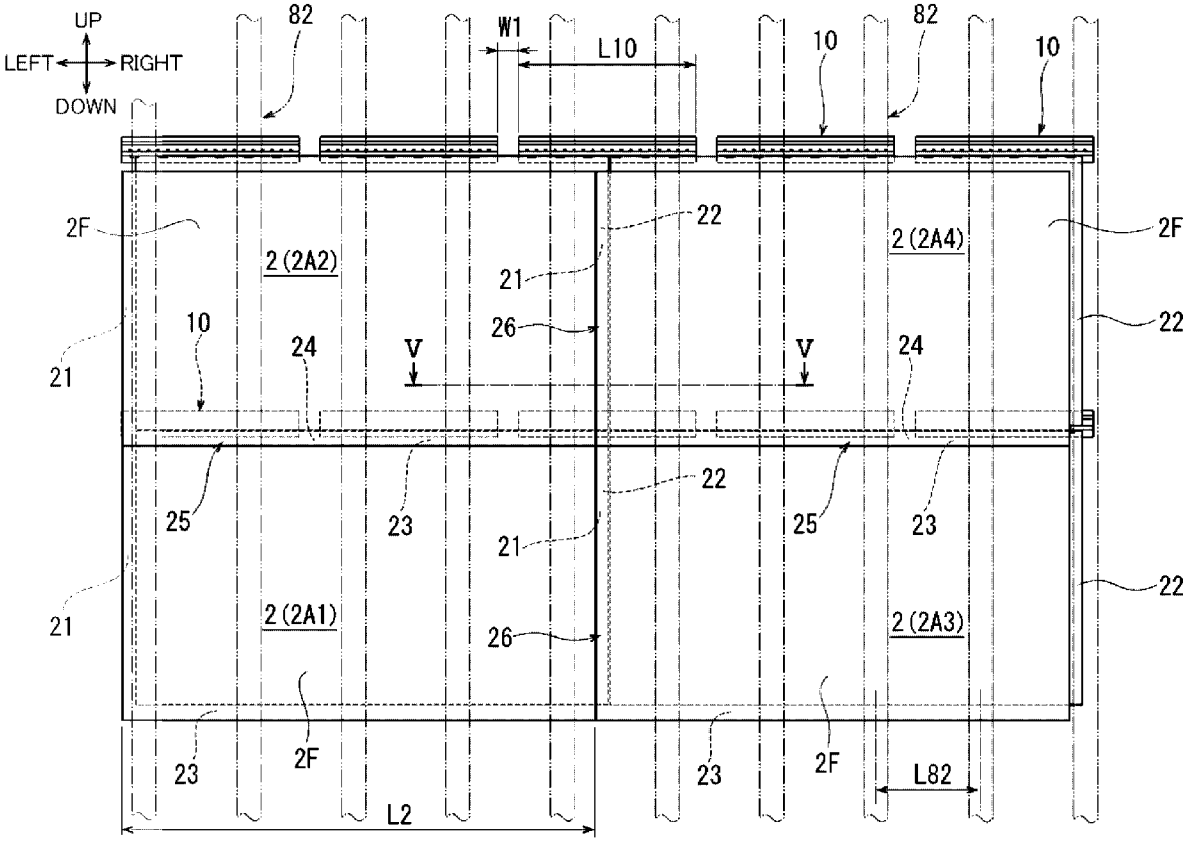
FIG. 4 is a front view illustrating the relative positional relationship between the exterior wall members, the second supporting members, and the securing members according to the first embodiment.

As illustrated in FIG. 1, an exterior insulation structure according to a first embodiment is an example of a specific form of a building exterior insulation structure of the present invention. This exterior insulation structure includes a framework 8, forming a building such as a house, a facility, or a storehouse, and multiple exterior wall members 2 attached to the framework 8 with double layers of thermal insulators being interposed therebetween. As illustrated in FIG. 2 to FIG. 4 and other drawings, the exterior wall members 2 are board members having high strength and rigidity and forming an outer wall of a building.

As illustrated FIG. 1, the framework 8 according to this embodiment is a frame of, for example, a steel structure or a wood structure. The framework 8 includes multiple framework components. The framework components include multiple columnar members 9, arranged at predetermined intervals in the lateral direction, and supplementary members such as studs disposed between the columnar members 9. The columnar members 9 or studs are formed of, for example, steel members having a specific shape or rectangular plank members. The framework 8 is not limited to the configuration according to this embodiment and may be, for example, a frame of, for example, a reinforced concrete structure or a brick structure.

Figure 5:
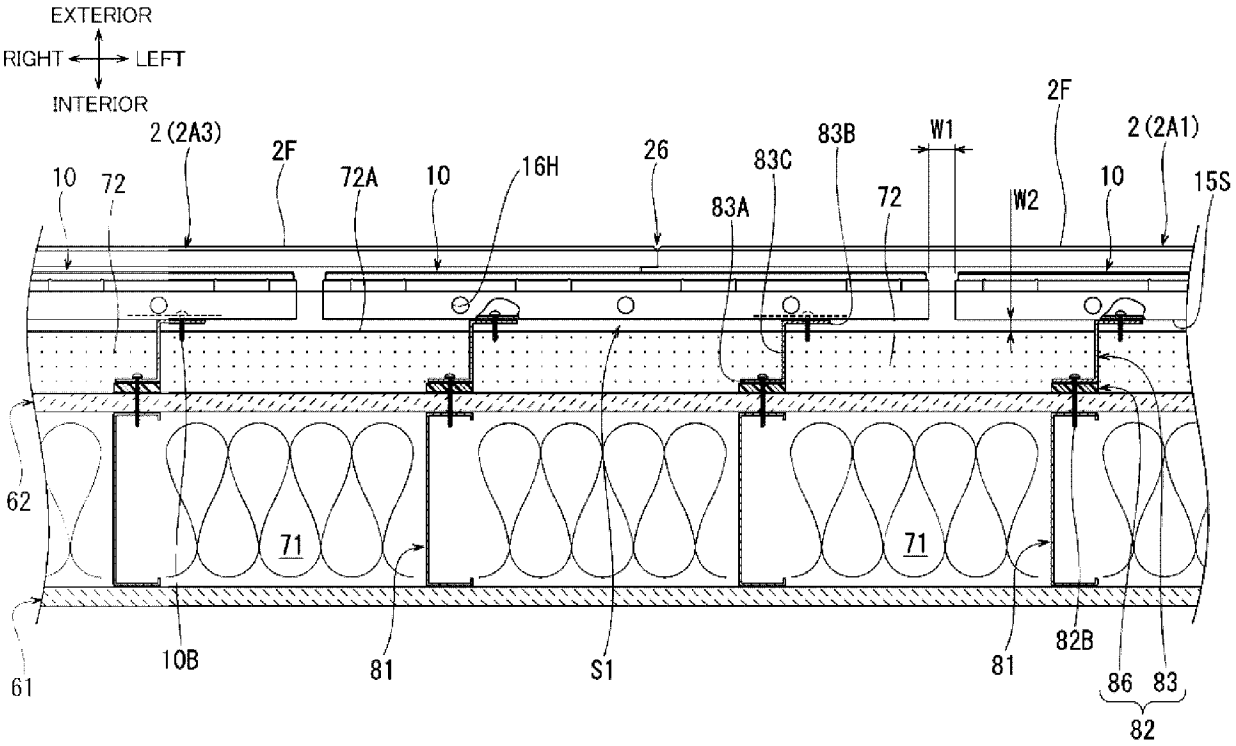
FIG. 5 is a partially sectional view taken along the line V-V of FIG. 4.

As illustrated in FIG. 1 and FIG. 5, first board members 61 are disposed on the exterior side of, for example, the columnar members 9 of the framework 8. In this embodiment, the first board members 61 are plaster boards having fire resistance and sound insulating properties. Instead, the first board members 61 may be, for example, structure panels such as structure plywood, which is a laminate made of thin layers of wood, or wood panels, obtained by shaping wood chips or fiber into boards. The first board members 61 are attached to the columnar members 9 and other members with setscrews and nails, not illustrated, and extend in the vertical direction and the lateral direction. The vertical direction is an example of "a first direction" in the present invention. The lateral direction is an example of "a second direction" in the present invention.

First supporting members 81 are disposed on the exterior side of the first board members 61. In this embodiment, each first supporting member 81 is a steel member having a specific shape such as a C-shaped steel member. The first supporting members 81 are attached to the columnar members 9 or other members using devices such as setscrews, not illustrated, with the first board members 61 interposed therebetween. The first supporting members 81 extend vertically and are spaced apart from one another in the lateral direction. In this embodiment, the lateral distance between adjacent first supporting members 81 is determined at a distance within a range from approximately 0.3 m to approximately 0.6 m with reference to the center lines.

First thermal insulators 71 are disposed on the exterior side of the first board members 61 and between the first supporting members 81. In this embodiment, the first thermal insulators 71 are fiber-based thermal insulators made of, for example, rock wool fiber of glass wool fiber. The first thermal insulators 71 may be plastic foam thermal insulators made of polyurethane foam, phenolic resin foam, or polystyrene foam.

Figure 6:
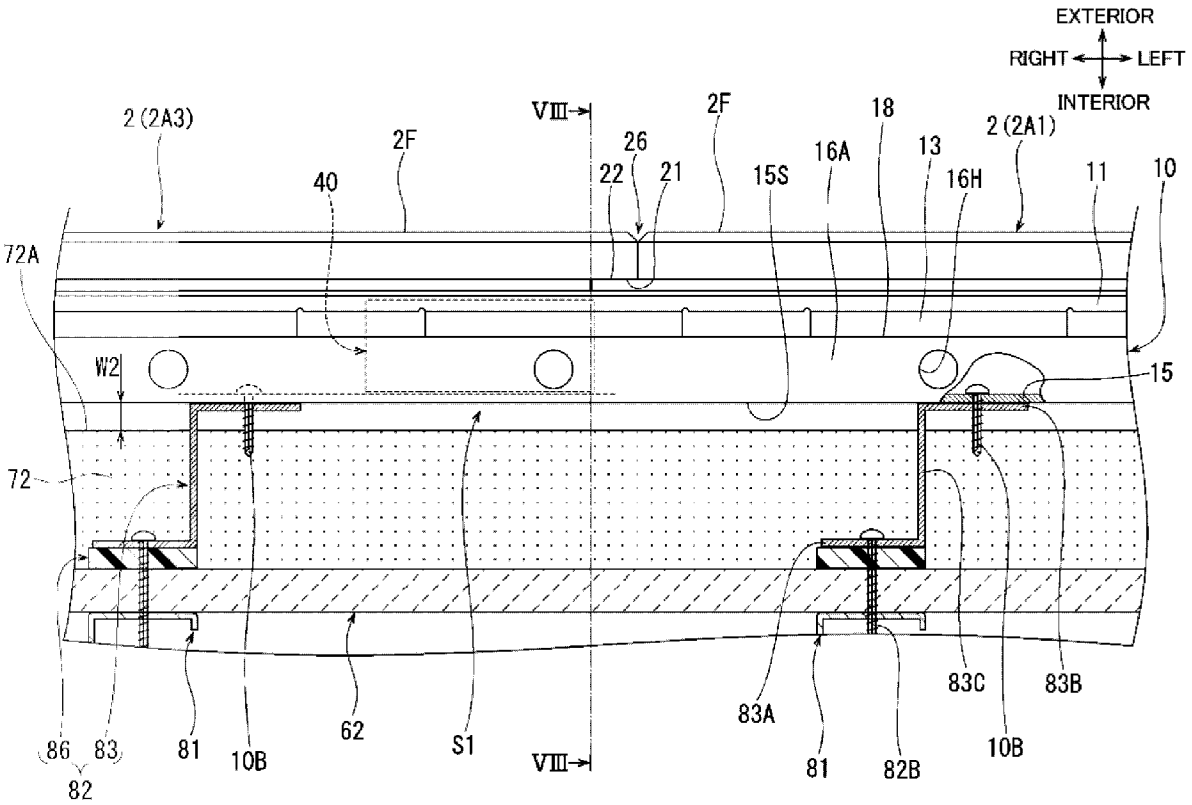
FIG. 6 is a partially enlarged sectional view of a main portion illustrated in FIG. 5.

Second board members 62 are disposed on the exterior side of the first supporting members 81 and the first thermal insulators 71. The second board members 62 are, for example, plaster boards having fire resistance and sound insulating properties. As illustrated in FIG. 5 and FIG. 6, the second board members 62 are attached to the first supporting members 81 together with second supporting members 82 using setscrews 82B. As illustrated in FIG. 1, the second board members 62 extend vertically and laterally to cover the exterior side of the first supporting members 81 and the first thermal insulators 71.

Waterproof sheets 6 are disposed over the exterior surface of the second board members 62. In FIG. 5 and FIG. 6, the waterproof sheets 6 are not illustrated. The waterproof sheets 6 are not essential. The waterproof sheets 6 according to the embodiment may be omitted.

The second supporting members 82 are disposed on the exterior side of the first supporting members 81, the first thermal insulators 71, the second board members 62, and the waterproof sheets 6. The second supporting members 82 correspond one to one to the first supporting members 81. The second supporting members 82 are disposed on the exterior side of the corresponding first supporting members 81 with the corresponding second board members 62 and the corresponding waterproof sheets 6 interposed therebetween. The second supporting members 82 extend vertically and are spaced apart from one another in the lateral direction. As in the case of the first supporting members 81, a lateral distance L82 between adjacent second supporting members 82 illustrated in FIG. 4 is determined at a distance within a range from approximately 0.3 m to approximately 0.6 m with reference to the center lines.

More specifically, as illustrated in FIG. 5 and FIG. 6, each second supporting member 82 includes a Z-shaped member 83 and a plank member 86. The Z-shaped member 83 is a steel member having a "Z" shaped cross section including a base portion 83A, disposed on the interior side, a securing portion 83B, disposed on the exterior side, and a connection portion 83C, connecting the base portion 83A and the securing portion 83B together. Each plank member 86 is a resin board having a thermal conductivity lower than that of steel, for example, a polypropylene foam resin board. Each plank member 86 is attached to the interior surface of the base portion 83A of the corresponding Z-shaped member 83 with, for example, a double-sided adhesive tape.

Each Z-shaped member 83 is an example of "a first portion" of the present invention. The plank member 86 is an example of "a second portion" of the present invention. Here, the cross-sectional shape of the Z-shaped member 83 described above is a mere example and may be, for example, a C-shaped, H-shaped, or hat-shaped cross section. The above-described material of the plank member 86 is also a mere example. Other materials are also usable as long as they have a thermal conductivity lower than that of steel. For example, the plank member 86 may be formed of a rock wool board.

Each setscrew 82B is screwed into the corresponding one of the first supporting members 81 through the corresponding base portion 83A of the Z-shaped member 83, the corresponding plank member 86, the corresponding waterproof sheet 6, and the corresponding second board member 62. Thus, each second supporting member 82 is attached to the corresponding first supporting member 81 with the corresponding waterproof sheet 6 and the corresponding second board member 62 interposed therebetween.

As illustrated in FIG. 1, second thermal insulators 72 are disposed on the exterior side of the first supporting members 81, the first thermal insulators 71, the second board members 62, and the waterproof sheets 6. In this embodiment, the second thermal insulators 72 are thermal insulators made of plastic foam such as polyurethane foam, phenolic foam, or polystyrene foam. The second thermal insulators 72 may be fiber-based thermal insulators made of, for example, rock wool fiber or glass wool fiber. The second thermal insulators 72 are each disposed between adjacent second supporting members 82 while adjoining the exterior surface of the second board members 62. In other words, the second board members 62 extend vertically and laterally between the first thermal insulators 71 and the second thermal insulators 72.

As illustrated in FIG. 5 and FIG. 6, a portion of each second thermal insulator 72 is cut into a step form at a position at which it can interfere with the base portion 83A of the Z-shaped member 83 and the plank member 86. The side surface of each second thermal insulator 72 is adjacent to the connection portion 83C of the corresponding Z-shaped member 83.

In each second supporting member 82, the connection portion 83C of the Z-shaped member 83 protrudes toward the exterior beyond exterior surfaces 72A of the second thermal insulators 72. Thus, the securing portion 83B of each Z-shaped member 83 is spaced apart from the exterior surface 72A of the corresponding second thermal insulator 72 toward the exterior.

Figure 7:
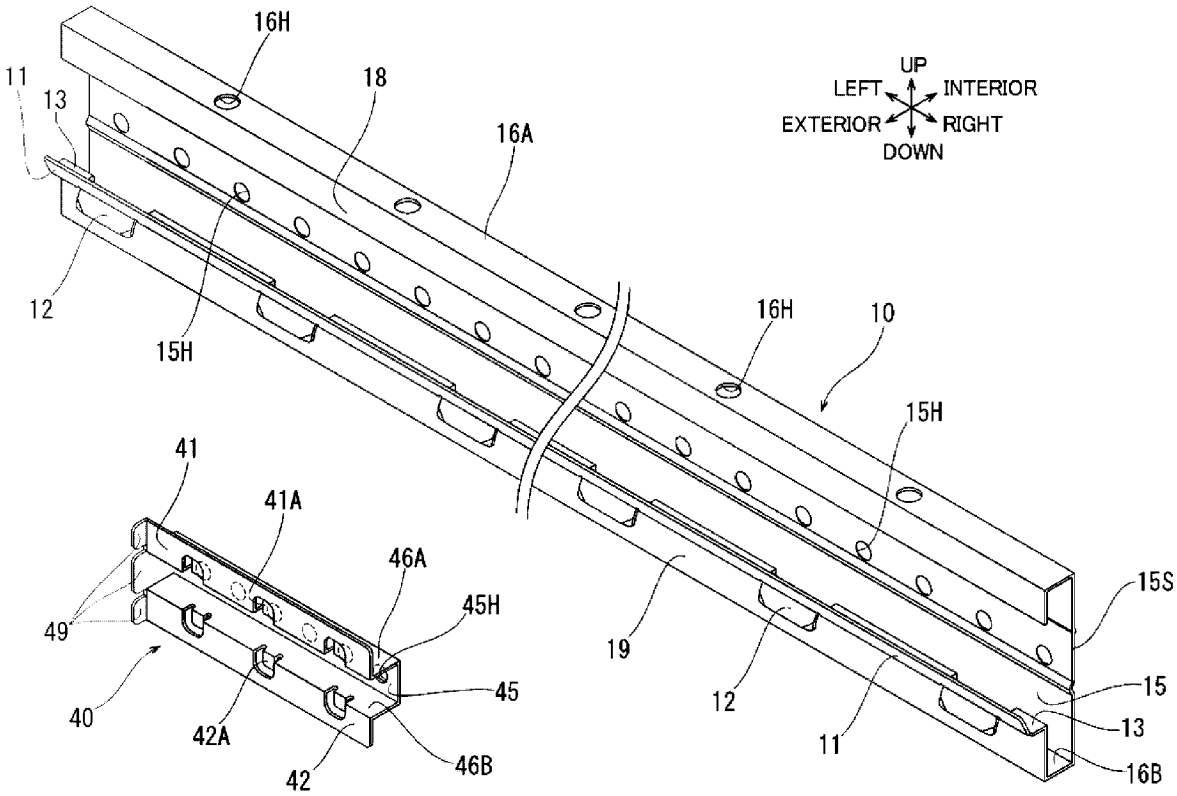
FIG. 7 is a perspective view of a securing member and a shift-prevention device according to the first embodiment.

Now, securing members 10 and shift-prevention devices 40 are described in detail. As illustrated in FIG. 7, the securing members 10 are manufactured by performing an operation on a metal plate, such as punching or bending a metal plate, the metal plate being made of a material such as iron or stainless steel. The material of the securing members 10 or the method for manufacturing the securing members 10 is not limited to the above-described ones. The securing members 10 may be made of any appropriately selected material or manufactured by any appropriately selected method. The material of the shift-prevention devices 40 or the method for manufacturing the shift-prevention devices 40 is not limited to the above-described ones, either, as in the case of the securing members 10.

As illustrated in FIG. 1, FIG. 4, FIG. 5, and other drawings, each securing member 10 is fixed to the exterior side of the second supporting members 82. Each securing member 10 is used for attaching the multiple exterior wall members 2 to the framework 8 while the exterior wall members 2 are arranged adjacent to one another in the vertical direction and the lateral direction. As illustrated in FIG. 4, the securing members 10 are arranged in lines extending in the lateral direction. The lines are arranged one on top of another in the vertical direction.

Figure 8:
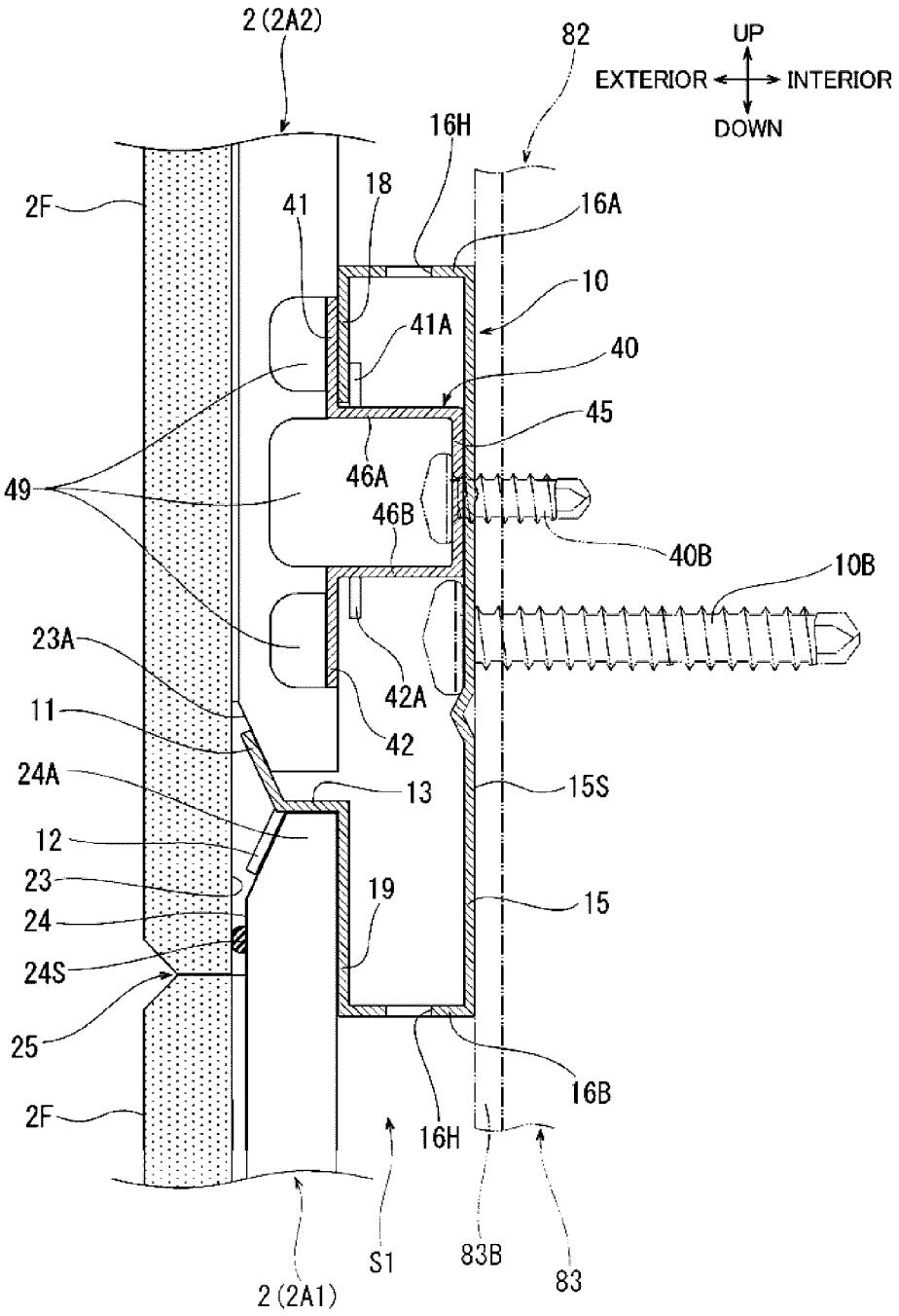
FIG. 8 is a partially sectional view taken along the line VIII-VIII of FIG. 6.
Figure 9:
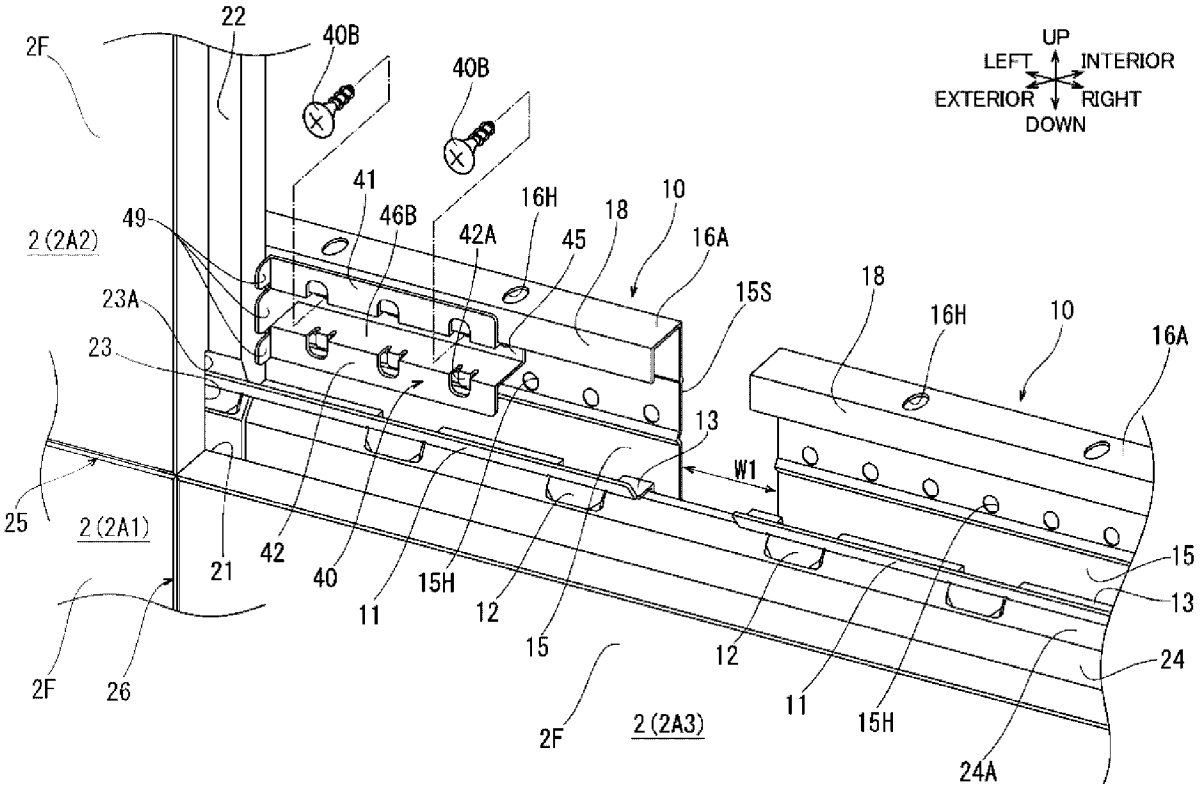
FIG. 9 is a partially perspective view illustrating a method for fixing the positions of the securing member, the shift-prevention device, and the exterior wall member according to the first embodiment.

As illustrated in FIG. 8 and FIG. 9, each shift-prevention device 40 is attached to a specific portion of the corresponding securing member 10 to prevent the exterior wall members 2 from shifting sideways.

In the following description, the orientation of each securing member 10 is described using as a reference a fixed position, in which a fixing portion 15 of the securing member 10 is fixed to the corresponding second supporting member 82, as illustrated in FIG. 6, FIG. 8, and other drawings. Specifically, the front surface of each securing member 10 faces toward the exterior and the back surface of the securing member 10 faces toward the interior. The longitudinal direction of each securing member 10 corresponds to the lateral direction.

In addition, the orientation of each shift-prevention device 40 is described using, as a reference, a position in which the shift-prevention device 40 is fastened to the corresponding securing member 10, as illustrated in FIG. 8 and FIG. 9. Specifically, the front surface of each shift-prevention device 40 faces toward the exterior and the back surface of the shift-prevention device 40 faces toward the interior. The longitudinal direction of each shift-prevention device 40 corresponds to the lateral direction.

As illustrated in FIG. 7 and other drawings, each securing member 10 is a long member extending laterally. As illustrated in FIG. 4, a laterally-extending length L10 of each securing member 10 is longer than a lateral interval L82 of the second supporting members 82 and shorter than a laterally-extending length L2 of each exterior wall member 2. The laterally-extending length L2 of each exterior wall member 2 is determined at approximately 1.8 m in this embodiment. The laterally-extending length L10 of each securing member 10 is determined at a length within a range of approximately 0.3 m to approximately 0.9 m in this embodiment, and longer than the interval L82.

As illustrated in FIG. 7 and other drawings, the fixing portion 15 of each securing member 10 is a substantially rectangular plate portion whose longitudinal direction coincides with the lateral direction. The surface of the fixing portion 15 facing in the direction the same as the direction in which the back surface of the securing member 10 faces is defined as a reference surface 15S of the fixing portion 15. Multiple fixing holes 15H are formed through the fixing portion 15 so as to be arranged in the lateral direction.

An upper bent portion 16A is bent at an upper edge of the fixing portion 15 to protrude toward the exterior and extends in the lateral direction. A lower bent portion 16B is bent at a lower edge of the fixing portion 15 to protrude toward the exterior and extends in the lateral direction.

An upper contact portion 18 is bent at an exterior side edge of the upper bent portion 16A to protrude downward and extends in the lateral direction. A lower contact portion 19 is bent at an exterior side edge of the lower bent portion 16B to protrude upward and extends in the lateral direction. The lower edge of the upper contact portion 18 and the upper edge of the lower contact portion 19 are spaced apart from each other to define a space therebetween.

Each securing member 10 has a frame structure having a "C-shaped" cross section formed by the fixing portion 15, the upper bent portion 16A, the lower bent portion 16B, the upper contact portion 18, and the lower contact portion 19 and has sufficiently high flexural rigidity. Multiple communicating holes 16H are formed through the upper bent portion 16A and the lower bent portion 16B. Each communicating hole 16H connects the inner side and the outer side of the "C-shaped" cross section to secure air permeability.

A support piece 13 is bent at an upper edge of the lower bent portion 16B to protrude toward the exterior and extends in the lateral direction. An upper hook piece 11 is bent at the exterior side edge of the support piece 13 to protrude upward and extends in the lateral direction. Multiple lower hook pieces 12 are formed by cutting multiple portions of the support piece 13 into substantially U shapes and bending center portions of the substantially U shapes downward. The lower hook pieces 12 are bent at the exterior side edge of the support piece 13 to protrude downward. The lower hook pieces 12 are arranged at intervals in the lateral direction.

As illustrated in FIG. 5 and FIG. 6, when the securing members 10, having the above-described length L10, are to be fixed to the second supporting members 82, the reference surface 15S of each securing member 10 comes into contact with the securing portions 83B of at least two second supporting members 82. Screws 10B are inserted into the respective fixing holes 15H located at positions at which the reference surface 15S comes into contact with the securing portions 83B and screwed into the securing portions 83B. Thus, each securing member 10 is fixed to the at least two second supporting members 82.

As illustrated in FIG. 4, FIG. 5, and FIG. 9, a first gap W1 is left between securing members 10 adjacent to each other in the lateral direction. The first gap W1 falls within a range of approximately 10 mm to 300 mm in this embodiment.

As illustrated in FIG. 5 and FIG. 6, since the securing portion 83B of the Z-shaped member 83 is spaced apart from the exterior surface 72A of the second thermal insulator 72 toward the exterior, a second gap W2 is left between the reference surface 15S of each securing member 10 and the exterior surface 72A of the corresponding second thermal insulator 72.

As illustrated in FIG. 7 and other drawings, each shift-prevention device 40 has a "hat-shaped" cross section extending a length shorter than that of each securing member 10 in the lateral direction. Each shift-prevention device 40 includes a fastening portion 45, an upper bent portion 46A, a lower bent portion 46B, an upper connection portion 41, a lower connection portion 42, and erect pieces 49.

The fastening portion 45 is a substantially rectangular plate portion extending in the lateral direction. Multiple fastening holes 45H formed through the fastening portion 45 are arranged in the lateral direction. The upper bent portion 46A is bent at the upper edge of the fastening portion 45 to protrude toward the exterior and extends in the lateral direction. The lower bent portion 46B is bent at the lower edge of the fastening portion 45 to protrude toward the exterior and extends in the lateral direction.

The upper connection portion 41 is bent at the exterior side edge of the upper bent portion 46A to protrude upward and extends in the lateral direction. The lower connection portion 42 is bent at the exterior side edge of the lower bent portion 46B to protrude downward and extends in the lateral direction.

The upper connection portion 41 has multiple small pieces 41A. The small pieces 41A are formed by cutting multiple portions of the upper connection portion 41 into substantially U shapes and bending center portions of the substantially U shapes upward at positions set back further toward the interior than the upper connection portion 41. The lower connection portion 42 has multiple small pieces 42A. The small pieces 42A are formed by cutting multiple portions of the lower connection portion 42 into substantially U shapes and bending center portions of the substantially U shapes downward at positions set back further toward the interior than the lower connection portion 42. The set of the upper connection portion 41 and the small pieces 41A and the set of the lower connection portion 42 and the small pieces 42A have a similar shape and are symmetrical with respect to the center line extending in the horizontal direction. A gap between the upper connection portion 41 and each small piece 41A and a gap between the lower connection portion 42 and each small piece 42A are fixed to such a size as to be capable of holding the upper contact portion 18 of the securing member 10.

The erect pieces 49 are bent at the left edge of the fastening portion 45, at the left edge of the upper connection portion 41, and at the left edge of the lower connection portion 42 to protrude toward the exterior.

As illustrated in FIG. 8 and FIG. 9, when each shift-prevention device 40 is to be fastened to the corresponding securing member 10, the fastening portion 45 is inserted between the upper contact portion 18 and the lower contact portion 19 of the securing member 10 and the upper connection portion 41 and the small pieces 41A hold the upper contact portion 18 in the state where the fastening portion 45 is superposed on the fixing portion 15 of the securing member 10. Then, screws 40B are inserted into the fastening holes 45H and screwed into the fixing portion 15, so that the shift-prevention device 40 is fastened at a desired portion of the securing member 10.

The shift-prevention device 40 is also usable in the position where the upper connection portion 41 and the lower connection portion 42 are vertically inverted so that the positions of the erect pieces 49 are changed from the left side to the right side.

As illustrated in FIG. 1, FIG. 2, FIG. 4, and other drawings, each exterior wall member 2 is a rectangular, or more specifically, substantially rectangular plank member longer in the lateral direction. In this embodiment, each exterior wall member 2 is made of a ceramic material containing cement. The material of the exterior wall members 2 is not limited to the above-described material and is appropriately selectable from, for example, metal, wood-based, and resin-based materials.

As illustrated in FIG. 1, FIG. 4, FIG. 9, and other drawings, the exterior wall members 2 are attached to the securing members 10 while being arranged so as to be adjacent to one another in the vertical direction and lateral direction to cover the exterior side of the framework 8.

As illustrated in FIG. 2 and FIG. 3, a front surface 2F of each exterior wall member 2 is an exterior surface having a design of, for example, a brick pattern. A front left-right joining portion 21 is formed at the left end portion of the exterior wall member 2. A back left-right joining portion 22 is formed at the right end portion of the exterior wall member 2. A front top-bottom joining portion 23 is formed at the lower end portion of the exterior wall member 2. A back top-bottom joining portion 24 is formed at the upper end portion of the exterior wall member 2.

In FIG. 2, the dimensions of the front left-right joining portion 21, the back left-right joining portion 22, the front top-bottom joining portion 23, and the back top-bottom joining portion 24 are illustrated in an exaggerated manner with respect to the dimensions of the exterior wall member 2.

The front left-right joining portion 21 is set back stepwise from the back surface of the exterior wall member 2 toward the front surface 2F and extends vertically, that is, along the left end portion of the exterior wall member 2.

The back left-right joining portion 22 is set back stepwise from the front surface 2F toward the back surface of the exterior wall member 2 and extends vertically, that is, along the right end portion of the exterior wall member 2. A caulking member 22S is disposed on the flat surface of the back left-right joining portion 22 facing toward the exterior. The caulking member 22S is disposed in a straight line along the back left-right joining portion 22. Here, the caulking member is not essential and the caulking member 22S according to the embodiment may be omitted.

The front top-bottom joining portion 23 is set back stepwise from the back surface of the exterior wall member 2 toward the front surface 2F and extends laterally, that is, along the lower end portion of the exterior wall member 2. The front top-bottom joining portion 23 has an engagement recess 23A, recessed so as to be substantially tapered toward the upper side.

The back top-bottom joining portion 24 is set back stepwise from the front surface 2F toward the back surface of the exterior wall member 2 and extends laterally, that is, along the upper end portion of the exterior wall member 2. A caulking member 24S is disposed on the flat surface of the back top-bottom joining portion 24 facing toward the exterior. The caulking member 24S is disposed in a straight line along the back top-bottom joining portion 24. Here, the caulking member is not essential and the caulking member 24S according to the embodiment may be omitted. The back top-bottom joining portion 24 has an engagement protrusion 24A, protruding so as to be substantially tapered toward the upper side from a portion above the caulking member 24S.

As illustrated in FIG. 4 to FIG. 6 and FIG. 9, a first shiplap portion 26 is formed between the exterior wall members 2 adjacent to each other in the lateral direction as a result of the front left-right joining portion 21 of one of the exterior wall members 2 and the back left-right joining portion 22 of the other exterior wall member 2 being superposed one on the other. As illustrated in FIG. 4, FIG. 8, and FIG. 9, a second shiplap portion 25 is formed between the exterior wall members 2 adjacent to each other in the vertical direction as a result of the front top-bottom joining portion 23 of one of the exterior wall members 2 and the back top-bottom joining portion 24 of the other exterior wall member 2 being superposed one on the other.

Specifically, each exterior wall member 2 is a plank member having a so-called "four-side shiplap structure" including the front left-right joining portion 21, the back left-right joining portion 22, the front top-bottom joining portion 23, and the back top-bottom joining portion 24. The first shiplap portion 26 is formed as a result of the front left-right joining portion 21 and the back left-right joining portion 22 being superposed one on the other and the second shiplap portion 25 is formed as a result of the front top-bottom joining portion 23 and the back top-bottom joining portion 24 being superposed one on the other. The exterior wall members 2 adjacent to each other in the vertical direction or lateral direction are joined together without leaving a gap therebetween at the first shiplap portion 26 or the second shiplap portion 25.

Here, as illustrated in FIG. 4 and other drawings, one of the exterior wall members 2 is defined as a first exterior wall member 2A1. Three exterior wall members 2 having the following relationships between themselves and the first exterior wall member 2A1 are defined as a second exterior wall member 2A2, a third exterior wall member 2A3, and a fourth exterior wall member 2A4. The second exterior wall member 2A2 adjoins the first exterior wall member 2A1 from above. The third exterior wall member 2A3 adjoins the first exterior wall member 2A1 from the right. The fourth exterior wall member 2A4 adjoins the third exterior wall member 2A3 from above and adjoins the second exterior wall member 2A2 from the right.

As illustrated in FIG. 8 and FIG. 9, the engagement protrusions 24A of the back top-bottom joining portions 24 of the first and third exterior wall members 2A1 and 2A3 are locked by the lower hook pieces 12 of the securing members 10.

As illustrated in FIG. 8 and FIG. 9, the engagement recess 23A of the front top-bottom joining portion 23 of the second exterior wall member 2A2 disposed on top of the first exterior wall member 2A1 is supported by the support pieces 13 of the securing members 10 and locked by the upper hook pieces 11. The shift-prevention device 40 is fastened to the securing member 10 while being superposed on the securing member 10 in the state where the erect pieces 49 abut against the right end portion of the second exterior wall member 2A2. Thereafter, as illustrated in FIG. 4, the fourth exterior wall member 2A4 is disposed on top of the third exterior wall member 2A3 and on the right side of the second exterior wall member 2A2. The engagement recess 23A of the front top-bottom joining portion 23 of the fourth exterior wall member 2A4 is also supported by the support pieces 13 of the securing members 10 and locked by the upper hook pieces 11.

In this state, as illustrated in FIG. 8, the back surfaces of the first and third exterior wall members 2A1 and 2A3 are supported by the lower contact portions 19 of the securing members 10. The back surfaces of the second and fourth exterior wall members 2A2 and 2A4 are supported by the upper contact portions 18 of the securing members 10. Thus, the first to fourth exterior wall members 2A1 to 2A4 are restrained from being shifted toward the interior. Thus, a ventilation space S1 is left between the exterior surfaces 72A of the second thermal insulators 72 and the back surfaces of the first to fourth exterior wall members 2A1 to 2A4.

In this state, the erect pieces 49 of the shift-prevention device 40 are disposed between opposing end portions of the second and fourth exterior wall members 2A2 and 2A4, opposing in the lateral direction, to prevent the second and fourth exterior wall members 2A2 and 2A4 from shifting sideways.

In this manner, the securing members 10 support the upper end portions of the first and third exterior wall members 2A1 and 2A3 and the lower end portions of the second and fourth exterior wall members 2A2 and 2A4. Although not illustrated, the upper end portions of the second and fourth exterior wall members 2A2 and 2A4 are supported by other securing members 10. Such an operation is also performed on other exterior wall members 2, so that the exterior wall members 2 cover the framework 8 while being adjacent to one another in the vertical direction and the lateral direction.

Operations and Effects of First Embodiment

In the building exterior insulation structure according to the first embodiment, the exterior wall members 2 attached to the securing members 10 cover the framework 8 in the state where each adjacent members are joined together without leaving a gap therebetween as illustrated in FIG. 4 to FIG. 6, FIG. 8, and FIG. 9. Thus, this exterior insulation structure has an enhanced appearance without the heads of the nails being exposed, unlike in an existing structure.

In this exterior insulation structure, each securing member 10 is fixed to the exterior side of at least two second supporting members 82, as illustrated in FIG. 4. This exterior insulation structure thus has enhanced strength for attaching the exterior wall members 2.

In this exterior insulation structure, adjacent exterior wall members 2 are joined together without leaving a gap therebetween, as illustrated in FIG. 6, FIG. 8, and other drawings. This exterior insulation structure is thus capable of preventing rainwater from intruding on the interior side of the exterior wall members 2. Here, as illustrated in FIG. 4, FIG. 5, and FIG. 9, air flows vertically through the first gap W1 left between the securing members 10 adjacent to each other in the lateral direction. As illustrated in FIG. 8, air also flows vertically through the communicating holes 16H formed through the upper bent portion 16A and the lower bent portion 16B of each securing member 10. Thus, as illustrated in FIG. 6 and FIG. 8, a sufficiently large ventilation space S1 extending widely in the vertical direction and the lateral direction is allowed to be left on the interior side of the exterior wall members 2. As illustrated in FIG. 6 and other drawings, the plank members 86 of the second supporting members 82 are made of a polypropylene foam resin having a thermal conductivity lower than that of steel. This exterior insulation structure is thus capable of preventing a heat transfer through the second supporting members 82 from or to the first supporting members 81 to or from the exterior wall members 2 and the securing members 10. This exterior insulation structure thus prevents the occurrence of condensation or other defects on the interior side of the exterior wall members 2 and thus has enhanced thermal insulation property.

Thus, the building exterior insulation structure according to the first embodiment is capable of enhancing the appearance, the strength for attaching the exterior wall members 2, and the thermal insulation property.

As illustrated in FIG. 5, in this exterior insulation structure, the second board members 62 separate the first thermal insulators 71 from the second thermal insulators 72. This exterior insulation structure is thus capable of preventing a heat transfer between the first thermal insulators 71 and the second thermal insulators 72. In addition, since the second board members 62 are made of a material such as plaster boards, this exterior insulation structure is capable of enhancing fire resistance and sound insulating properties.

In addition, in this exterior insulation structure, the second gap W2 left between the securing members 10 and the exterior surfaces 72A of the second thermal insulators 72, as illustrated in FIG. 6, increases the capacity of the ventilation space S1 left on the interior side of the exterior wall members 2. This exterior insulation structure thus increases the amount of ventilation in the ventilation space S1 and is thus capable of effectively removing the humidity on the interior side of the exterior wall members 2. In addition, this exterior insulation structure further prevents a heat transfer between the securing members 10 and the second thermal insulators 72 since the reference surfaces 15S of the securing members 10 do not directly come into contact with the second thermal insulators 72. Thus, this exterior insulation structure is capable of further preventing condensation or other defects from occurring on the interior side of the exterior wall members 2 and thus has further enhanced thermal insulation property.

In addition, in this exterior insulation structure, the Z-shaped members 83 made of steel and included in the second supporting members 82 allow the securing members 10 to be tightly fixed thereto and are capable of enhancing durability against fire. In this exterior insulation structure, the plank members 86 having a thermal conductivity lower than that of steel, with which the other portion of each second supporting member 82 is formed, are capable of effectively preventing a heat transfer through the second supporting members 82 from or to the first supporting members 81 to or from exterior wall members 2 and the securing members 10.

In this exterior insulation structure, the plank member 86 is located at a portion of each second supporting member 82 closer to the corresponding first supporting member 81. More specifically, the plank member 86 is attached to the base portion 83A of the corresponding Z-shaped member 83 using a double-sided adhesive tape or the like. Thus, in this exterior insulation structure, the second supporting member 82 and the securing member 10 are capable of firmly fixed to each other. In addition, the structure of the second supporting members 82 can be easily simplified. This structure can thus reduce component costs and construction costs.

In this exterior insulation structure, as illustrated in FIG. 6, FIG. 8, and other drawings, adjacent exterior wall members 2 are joined together by four-side shiplapping without leaving a gap therebetween at the first shiplap portion 26 and the second shiplap portion 25. Thus, this exterior insulation structure is capable of further effectively preventing rainwater from intruding on the interior side of the exterior wall members 2 and further enhancing the appearance. In this exterior insulation structure, as illustrated in FIG. 8 and FIG. 9, the erect pieces 49 of each shift-prevention device 40 are disposed between opposing end portions of the second and fourth exterior wall members 2A2 and 2A4, opposing in the lateral direction. Thus, the second and fourth exterior wall members 2A2 and 2A4 are capable of being effectively prevented from shifting sideways.

In this exterior insulation structure, as illustrated in FIG. 8 and FIG. 9, each shift-prevention device 40 is attached to the corresponding securing member 10 so as to be superposed on the securing member 10. Thus, the area of the second supporting member 82 with which the securing member 10 and the shift-prevention device 40 come into contact can be reduced compared to the case where the shift-prevention device 40 is fixed to the second supporting member 82 at a portion of the second supporting member 82 different from the portion at which the securing member 10 is fixed to the second supporting member 82. This exterior insulation structure is thus capable of further enhancing the thermal insulation property.

Second Embodiment

Figure 10:
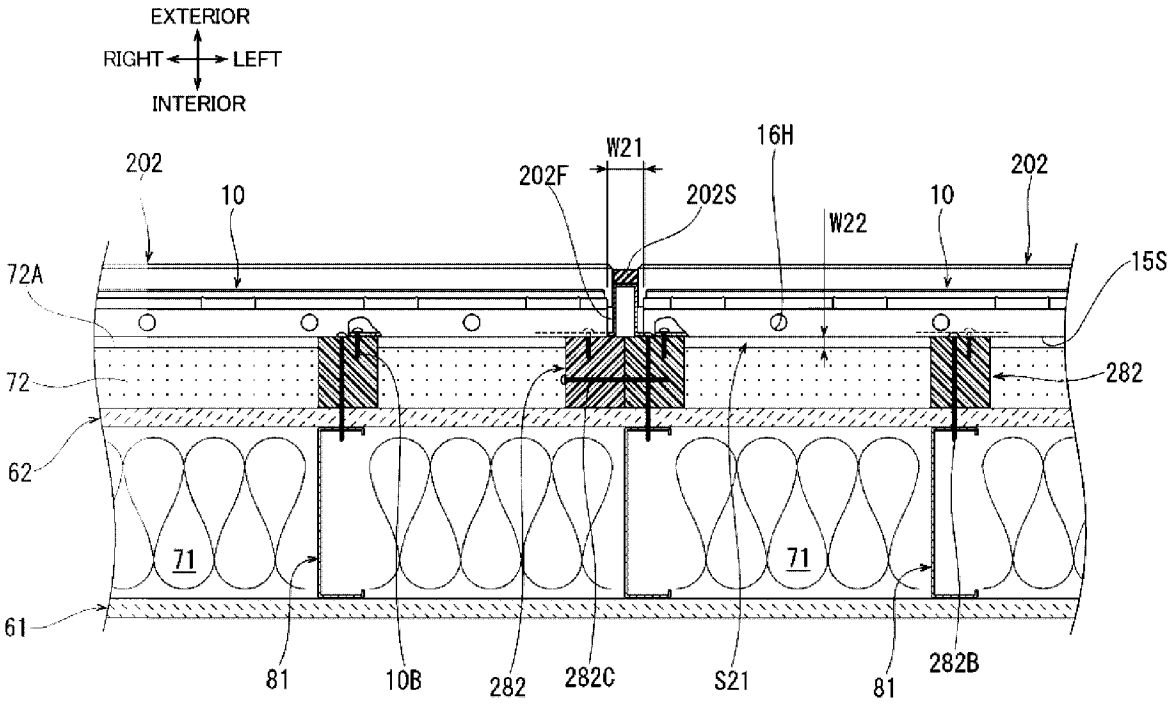
FIG. 10 is a partially sectional view according to a second embodiment similarly taken along the line V-V of FIG. 4.
Figure 11:
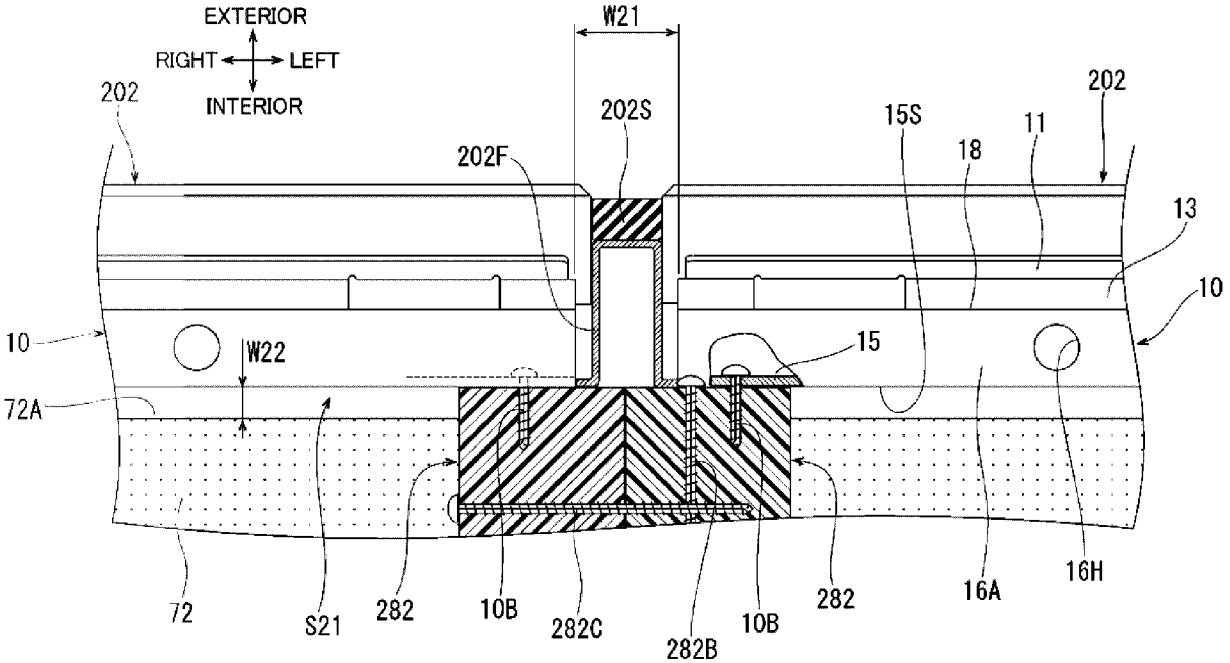
FIG. 11 is an enlarged partially sectional view of a main portion illustrated in FIG. 10.

In a building exterior insulation structure according to a second embodiment, exterior wall members 202 and second supporting members 282 are employed instead of the exterior wall members 2 and the second supporting members 82 according to the first embodiment, as illustrated in FIG. 10 and FIG. 11. Other components according to the second embodiment are the same as those according to the first embodiment. Thus, components the same as those according to the first embodiment are denoted with the same reference symbols and the description of the components is omitted or simplified.

The exterior wall members 202 are plank members having a so-called "side-edge butt-joint structure", not including the front left-right joining portion 21 and the back left-right joining portion 22 of each exterior wall member 2 according to the first embodiment. A spacer 202F having a "hat-shaped" cross section is disposed between opposing end portions of the exterior wall members 202 adjacent to each other in the lateral direction. A space defined by the spacer 202F and the opposing end portions of the adjacent exterior wall members 202 is filled with a sealing agent 202S. Thus, the exterior wall members 202 adjacent to each other in the lateral direction are joined together without leaving a gap therebetween.

The second supporting members 282 are prisms made of a polypropylene foam resin having a thermal conductivity lower than that of steel as a whole. The above-described cross-sectional shape of the second supporting members 282 is a mere example and the cross-sectional shape may be, for example, a trapezoid or an angular tube. The above-described material of the second supporting members 282 is also a mere example and other materials such as rock wool may be used instead as long as the materials have a thermal conductivity lower than that of steel.

As illustrated in FIG. 10, a long setscrew 282B is screwed into the corresponding first supporting member 81 after passing through the corresponding second supporting member 282, the waterproof sheet 6, and the second board member 62. Thus, each of the second supporting members 282 is attached to the corresponding one of the first supporting members 81 with the waterproof sheet 6 and the second board member 62 interposed therebetween.

In addition, another second supporting member 282 is disposed adjacent, in the lateral direction, to the second supporting member 282 disposed at a position corresponding to a joint between the adjacent exterior wall members 202. Another setscrew 282C is screwed into these second supporting members 282 so as to extend sideways.

A lateral interval between the second supporting members 282 is determined at an interval within a range of approximately 0.3 m to approximately 0.6 m with reference to the center lines, as in the case of the second supporting members 82 according to the first embodiment.

When each securing member 10 having the above-described length L10, is fixed to the corresponding second supporting members 282, the reference surface 15S of the securing member 10 comes into contact with the exterior surfaces of at least two second supporting members 282. Screws 10B are then inserted into the fixing holes 15H at which the reference surface 15S and the second supporting members 282 come into contact with each other and screwed into the second supporting members 282. Thus, the securing member 10 is fixed to the at least two second supporting members 282.

A first gap W21 is left between the securing members 10 adjacent to each other in the lateral direction. The first gap W21 falls within a range of approximately 10 mm to 30 mm, in this embodiment.

Each second supporting member 282 protrudes toward the exterior beyond the exterior surface 72A of the second thermal insulator 72. Thus, a second gap W22 is left between the reference surface 15S of each securing member 10 and the exterior surface 72A of the second thermal insulator 72.

Operations and Effects of Second Embodiment

In the building exterior insulation structure according to the second embodiment, as illustrated in FIG. 10 and FIG. 11, the exterior wall members 202 attached to the securing members 10 cover the framework 8 while opposing end portions of the exterior wall members 202 adjacent to each other in the lateral direction are joined together by the sealing agent 202S without leaving a gap therebetween. Thus, this exterior insulation structure has an enhanced appearance without the heads of the nails being exposed, unlike in an existing structure.

In this exterior insulation structure, the securing members 10 are fixed to the exterior side of at least two second supporting members 282. The exterior insulation structure thus has enhanced strength for attaching the exterior wall members 202.

In this exterior insulation structure, the exterior wall members 202 adjacent to each other in the lateral direction are joined together by the sealing agent 202S without leaving a gap therebetween. This exterior insulation structure is thus capable of preventing rainwater from intruding on the interior side of the exterior wall members 202. Here, air flows vertically through the first gap W21 left between the securing members 10 adjacent to each other in the lateral direction. In addition, air also flows vertically through the communicating holes 16H formed through the upper bent portion 16A and the lower bent portion 16B of each securing member 10. Thus, a sufficiently large ventilation space S21 extending widely in the vertical direction and the lateral direction is allowed to be left on the interior side of the exterior wall members 202. In addition, the second gap W22 left between the securing members 10 and the exterior surfaces 72A of the second thermal insulators 72 increases the capacity of the ventilation space S21 left on the interior side of the exterior wall members 202. The entirety of each second supporting member 282 is made of a material, such as a polypropylene foam resin, having a thermal conductivity lower than that of steel. Specifically, the second supporting members 282 themselves have thermal insulation effect. This exterior insulation structure is thus capable of effectively preventing a heat transfer through the second supporting members 282 from or to the first supporting members 81 to or from the exterior wall members 202 and the securing member 10. This exterior insulation structure thus prevents the occurrence of condensation or other defects on the interior side of the exterior wall members 202 and has further enhanced thermal insulation property.

As in the case of the building exterior insulation structure according to the first embodiment, the building exterior insulation structure according to the second embodiment is also capable of enhancing the appearance, the strength for attaching the exterior wall members 202, and the thermal insulation property.

Embodiments of the present invention have been described thus far using the first and second embodiments. Embodiments of the present invention, however, are not limited to the first and second embodiments. The present invention is naturally applicable to forms appropriately modified within a range not departing from the gist of the invention.

For example, in the first and second embodiments, the first direction is defined as the vertical direction and the second direction is defined as the lateral direction. This is not the only possible configuration, however. For example, the first direction may be the lateral direction and the second direction may be the vertical direction.

In the first embodiment, the position of the second portion (plank member) 86 of each second supporting member 82 may be changed to the position at a portion of the second supporting member 82 closer to the securing member 10. This configuration is capable of tightly fixing the first supporting member 81 and the base portion 83A of the first portion (Z-shaped member) 83 of the second supporting member 82 to each other. The second portion 86 of each second supporting member 82 may be located at a middle portion of the second supporting member 82.

The configuration excluding the second board members 62 from the building exterior insulation structure according to the first and second embodiments is also included in the invention.

What is claimed is:

1. A building exterior insulation structure, comprising:

a first board member disposed on an exterior side of a framework forming a building, the first board member extending in a first direction and a second direction substantially perpendicular to the first direction;

a plurality of first supporting members disposed on the exterior side of the first board member;

at least one first thermal insulator disposed on the exterior side of the first board member and between the first supporting members;

a plurality of second supporting members disposed on the exterior side of the first supporting members, the second supporting members extending in the first direction and being spaced part from one another in the second direction; and at least one second thermal insulator disposed on the exterior side of the first thermal insulator and between the second supporting members;

a plurality of securing members fixed to the exterior side of the second supporting members and extending in the second direction; and a plurality of exterior wall members attached to the securing members to cover the framework, wherein the exterior wall members adjacent to each other are joined together without leaving a gap therebetween, wherein a length of each securing member in the second direction is determined so as to be long enough to be fixable to at least two of the second supporting members and so as to be shorter than a length of each exterior wall member in the second direction, wherein a first gap is left between each two of the securing members adjacent to each other in the second direction, and wherein at least part of each second supporting member is made of a material having a thermal conductivity lower than that of steel.

2. The building exterior insulation structure according to claim 1, further comprising:

a second board member disposed on the exterior side of each first supporting member, the second board member extending in the first direction and the second direction in a space between the first thermal insulator and the second thermal insulator, wherein the second supporting members are disposed on the exterior side of the first supporting members with the second board member interposed therebetween.

3. The building exterior insulation structure according to claim 1, wherein a second gap is left between each securing member and an exterior surface of the second thermal insulator.

4. The building exterior insulation structure according to claim 1, wherein each second supporting member includes a first portion, made of a metal, and a second portion, made of a material containing either a resin material or rock wool or both a resin material and rock wool.

5. The building exterior insulation structure according to claim 4, wherein the second portion is located at a portion of each second supporting member closer to a corresponding one of the first supporting members than to a corresponding one of the securing members or closer to the corresponding one of the securing members than to the corresponding one of the first supporting members.

6. The building exterior insulation structure according to claim 1, wherein the second supporting members are made of a material containing either a resin material or rock wool or both a resin material and rock wool.

7. The building exterior insulation structure according to claim 1, wherein a sealing agent is disposed between each two of the exterior wall members adjacent to each other in the second direction.

8. The building exterior insulation structure according to claim 1, wherein each two of the exterior wall members adjacent to each other in the second direction have a first shiplap portion.

9. The building exterior insulation structure according to claim 8, wherein each two of the exterior wall members adjacent to each other in the first direction have a second shiplap portion.

10. The building exterior insulation structure according to claim 9, further comprising:

at least one shift-prevention device including an erect piece disposed between opposing end portions of each two of the exterior wall members adjacent to each other in the second direction.

11. The building exterior insulation structure according to claim 10, wherein the shift-prevention device is attached to each securing member while being superposed on the securing member.

* * * * *